US006567111B2

(12) United States Patent
Kojima

(10) Patent No.: US 6,567,111 B2
(45) Date of Patent: May 20, 2003

(54) IMAGE RECORDING METHOD AND APPARATUS

(75) Inventor: Tetsuya Kojima, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/989,385

(22) Filed: Nov. 21, 2001

(65) Prior Publication Data

US 2002/0071022 A1 Jun. 13, 2002

(30) Foreign Application Priority Data

Nov. 22, 2000 (JP) ..... 2000-356575

(51) Int. Cl.[7] ..... B41J 2/355
(52) U.S. Cl. ..... 347/183; 347/184
(58) Field of Search ..... 347/180, 181, 347/182, 183, 184, 211; 400/120.05, 120.06, 120.07

(56) References Cited

U.S. PATENT DOCUMENTS 4,691,211 A * 9/1987 Brownstein ..... 347/180
4,779,102 A * 10/1988 Sasaki ..... 347/180
5,438,352 A * 8/1995 Agano ..... 347/183
6,034,707 A 3/2000 Agano
6,396,527 B1 * 5/2002 Yamaguchi ..... 347/183
2001/0008405 A1 * 7/2001 Yamane et al.

FOREIGN PATENT DOCUMENTS

JP 5-270037 * 10/1993 ..... B41J/2/355
JP 7-96625 4/1995
JP 10-44509 2/1998

* cited by examiner

*Primary Examiner*—Huan Tran
(74) *Attorney, Agent, or Firm*—Sughrue Mion, PLLC

(57) ABSTRACT

This invention relates to image recording method and apparatus. The apparatus has an image recording unit which records an image in a one-dimensional direction, a transfer unit which transfers the image recording unit with relative to a recording medium, which are moved in mutually perpendicular directions, and a recording control unit which controls and records a single pixel using a plurality of pulses upon recording of the image, the recording control unit performing control so that thermal patterns at neighboring pixels are shifted to perform the image recording.

13 Claims, 7 Drawing Sheets

132 DISPERSION 16×127+1+2+4+8

DATA LEVEL 1027

| DISPERSION NUMBER OF DATA TO BE RECORDED (0~131) | PULSE WIDTH | PIXEL POSITION (0~191) COMMAND VALUE | 0 | 1 | 2 | 3 | 4 | 5 | 6 | 7 | 8 | 9 | 10 | | 185 | 186 | 187 | 188 | 189 | 190 | 191 | NUMBER OF ON-PULSES AT EACH TIME |
|---|---|---|---|---|---|---|---|---|---|---|---|---|---|---|---|---|---|---|---|---|---|---|
| | | | 1027 | 1027 | 1027 | 1027 | 1027 | 1027 | 1027 | 1027 | 1027 | 1027 | 1027 | | 1027 | 1027 | 1027 | 1027 | 1027 | 1027 | 1027 | |
| 0 | 32 | | 0 | 0 | 0 | 32 | 0 | 0 | 0 | 32 | 0 | 0 | 0 | | 0 | 0 | 0 | 32 | 0 | 0 | 0 | 49 |
| 1 | 32 | | 32 | 0 | 0 | 0 | 32 | 0 | 0 | 0 | 32 | 0 | 0 | | 32 | 0 | 0 | 0 | 32 | 0 | 0 | 48 |
| 2 | 32 | | 0 | 32 | 0 | 0 | 0 | 32 | 0 | 0 | 0 | 32 | 0 | | 0 | 32 | 0 | 0 | 0 | 32 | 0 | 48 |
| 3 | 32 | | 0 | 0 | 32 | 0 | 0 | 0 | 32 | 0 | 0 | 0 | 32 | | 0 | 0 | 32 | 0 | 0 | 0 | 32 | 49 |
| 4 | 32 | | 0 | 0 | 0 | 32 | 0 | 0 | 0 | 32 | 0 | 0 | 0 | | 0 | 0 | 0 | 32 | 0 | 0 | 0 | 49 |
| 5 | 32 | | 32 | 0 | 0 | 0 | 32 | 0 | 0 | 0 | 32 | 0 | 0 | ... | 32 | 0 | 0 | 0 | 32 | 0 | 0 | 47 |
| 6 | 32 | | 0 | 32 | 0 | 0 | 0 | 32 | 0 | 0 | 0 | 32 | 0 | | 0 | 32 | 0 | 0 | 0 | 32 | 0 | 49 |
| 7 | 32 | | 0 | 0 | 32 | 0 | 0 | 0 | 32 | 0 | 0 | 0 | 32 | | 0 | 0 | 32 | 0 | 0 | 0 | 32 | 49 |
| 8 | 32 | | 0 | 0 | 0 | 32 | 0 | 0 | 0 | 32 | 0 | 0 | 0 | | 0 | 0 | 0 | 32 | 0 | 0 | 0 | 48 |
| 9 | 32 | | 32 | 0 | 0 | 0 | 32 | 0 | 0 | 0 | 32 | 0 | 0 | | 32 | 0 | 0 | 0 | 32 | 0 | 0 | 48 |
| 10 | 32 | | 0 | 32 | 0 | 0 | 0 | 32 | 0 | 0 | 0 | 32 | 0 | | 0 | 32 | 0 | 0 | 0 | 32 | 0 | 49 |
| 11 | 32 | | 0 | 0 | 32 | 0 | 0 | 0 | 32 | 0 | 0 | 0 | 32 | | 0 | 0 | 32 | 0 | 0 | 0 | 32 | 49 |
| ⋮ | ⋮ | | | | | | ... | | | | | | | | | | ... | | | | | ⋮ |
| 125 | 32 | | 32 | 32 | 0 | 0 | 0 | 32 | 0 | 0 | 0 | 32 | 0 | | 0 | 32 | 0 | 0 | 0 | 32 | 0 | 48 |
| 126 | 32 | | 0 | 0 | 32 | 0 | 0 | 0 | 32 | 0 | 0 | 0 | 32 | | 0 | 0 | 32 | 0 | 0 | 0 | 32 | 49 |
| 127 | 1 | | 1 | 1 | 1 | 1 | 1 | 1 | 1 | 1 | 1 | 1 | 1 | | 1 | 1 | 1 | 1 | 1 | 1 | 1 | 193 |
| 128 | 2 | | 2 | 2 | 2 | 2 | 2 | 2 | 2 | 2 | 2 | 2 | 2 | | 2 | 2 | 2 | 2 | 2 | 2 | 2 | 193 |
| 129 | 4 | | 0 | 0 | 0 | 0 | 0 | 0 | 0 | 0 | 0 | 0 | 0 | | 0 | 0 | 0 | 0 | 0 | 0 | 0 | 0 |
| 130 | 8 | | 0 | 0 | 0 | 0 | 0 | 0 | 0 | 0 | 0 | 0 | 0 | | 0 | 0 | 0 | 0 | 0 | 0 | 0 | 0 |
| 131 | 16 | | 0 | 0 | 0 | 0 | 0 | 0 | 0 | 0 | 0 | 0 | 0 | | 0 | 0 | 0 | 0 | 0 | 0 | 0 | 0 |

FIG.3

132 DISPERSION 16×127+1+2+4+8

DATA LEVEL 1027

| DISPERSION NUMBER OF DATA TO BE RECORDED (0~131) | PULSE WIDTH | PIXEL POSITION (0~191) | | | | | | | | | | | | | | | | | | | NUMBER OF ON-PULSES AT EACH TIME |
|---|---|---|---|---|---|---|---|---|---|---|---|---|---|---|---|---|---|---|---|---|---|
| | | COMMAND VALUE | 0 | 1 | 2 | 3 | 4 | 5 | 6 | 7 | 8 | 9 | 10 | | 185 | 186 | 187 | 188 | 189 | 190 | 191 | |
| | | | 1027 | 1027 | 1027 | 1027 | 1027 | 1027 | 1027 | 1027 | 1027 | 1027 | 1027 | | 1027 | 1027 | 1027 | 1027 | 1027 | 1027 | 1027 | |
| 0 | 32 | | 0 | 0 | 0 | 32 | 0 | 0 | 0 | 32 | 0 | 0 | 0 | | 0 | 0 | 0 | 32 | 0 | 0 | 0 | 49 |
| 1 | 32 | | 32 | 0 | 0 | 0 | 32 | 0 | 0 | 0 | 32 | 0 | 0 | | 32 | 0 | 0 | 0 | 32 | 0 | 0 | 48 |
| 2 | 32 | | 0 | 32 | 0 | 0 | 0 | 32 | 0 | 0 | 0 | 32 | 0 | | 0 | 32 | 0 | 0 | 0 | 32 | 0 | 48 |
| 3 | 32 | | 0 | 0 | 32 | 0 | 0 | 0 | 32 | 0 | 0 | 0 | 32 | | 0 | 0 | 32 | 0 | 0 | 0 | 32 | 49 |
| 4 | 32 | | 0 | 0 | 0 | 32 | 0 | 0 | 0 | 32 | 0 | 0 | 0 | | 0 | 0 | 0 | 32 | 0 | 0 | 0 | 49 |
| 5 | 32 | | 32 | 0 | 0 | 0 | 32 | 0 | 0 | 0 | 32 | 0 | 0 | ... | 32 | 0 | 0 | 0 | 32 | 0 | 0 | 47 |
| 6 | 32 | | 0 | 32 | 0 | 0 | 0 | 32 | 0 | 0 | 0 | 32 | 0 | | 0 | 32 | 0 | 0 | 0 | 32 | 0 | 49 |
| 7 | 32 | | 0 | 0 | 32 | 0 | 0 | 0 | 32 | 0 | 0 | 0 | 32 | | 0 | 0 | 32 | 0 | 0 | 0 | 32 | 49 |
| 8 | 32 | | 0 | 0 | 0 | 32 | 0 | 0 | 0 | 32 | 0 | 0 | 0 | | 0 | 0 | 0 | 32 | 0 | 0 | 0 | 48 |
| 9 | 32 | | 32 | 0 | 0 | 0 | 32 | 0 | 0 | 0 | 32 | 0 | 0 | | 32 | 0 | 0 | 0 | 32 | 0 | 0 | 48 |
| 10 | 32 | | 0 | 32 | 0 | 0 | 0 | 32 | 0 | 0 | 0 | 32 | 0 | | 0 | 32 | 0 | 0 | 0 | 32 | 0 | 49 |
| 11 | 32 | | 0 | 0 | 32 | 0 | 0 | 0 | 32 | 0 | 0 | 0 | 32 | | 0 | 0 | 32 | 0 | 0 | 0 | 32 | 49 |
| ⋮ | ⋮ | | | | | | ... | | | | | | | | | | ... | | | | | ⋮ |
| 125 | 32 | | 32 | 32 | 0 | 0 | 0 | 32 | 0 | 0 | 0 | 32 | 0 | | 0 | 32 | 0 | 0 | 0 | 32 | 0 | 48 |
| 126 | 32 | | 0 | 0 | 32 | 0 | 0 | 0 | 32 | 0 | 0 | 0 | 32 | | 0 | 0 | 32 | 0 | 0 | 0 | 32 | 49 |
| 127 | 1 | | 1 | 1 | 1 | 1 | 1 | 1 | 1 | 1 | 1 | 1 | 1 | | 1 | 1 | 1 | 1 | 1 | 1 | 1 | 193 |
| 128 | 2 | | 2 | 2 | 2 | 2 | 2 | 2 | 2 | 2 | 2 | 2 | 2 | | 2 | 2 | 2 | 2 | 2 | 2 | 2 | 193 |
| 129 | 4 | | 0 | 0 | 0 | 0 | 0 | 0 | 0 | 0 | 0 | 0 | 0 | | 0 | 0 | 0 | 0 | 0 | 0 | 0 | 0 |
| 130 | 8 | | 0 | 0 | 0 | 0 | 0 | 0 | 0 | 0 | 0 | 0 | 0 | | 0 | 0 | 0 | 0 | 0 | 0 | 0 | 0 |
| 131 | 16 | | 0 | 0 | 0 | 0 | 0 | 0 | 0 | 0 | 0 | 0 | 0 | | 0 | 0 | 0 | 0 | 0 | 0 | 0 | 0 |

FIG. 5 (TABLE 1)

| |
|---|
| "width 32" × 127 + "width 16" + "width 8" + "width 4" + "width 2" + "width 1"<br>(132 steps of dispersion, 132 pulse transfers) |
| "width 16" × 225 + "width 8" + "width 4" + "width 2" + "width 1"<br>(259 steps of dispersion, 259 pulse transfers) |
| "width 8" × 511 + "width 4" + "width 2" + "width 1"<br>(514 steps of dispersion, 514 pulse transfers) |

FIG. 6 (TABLE 2)
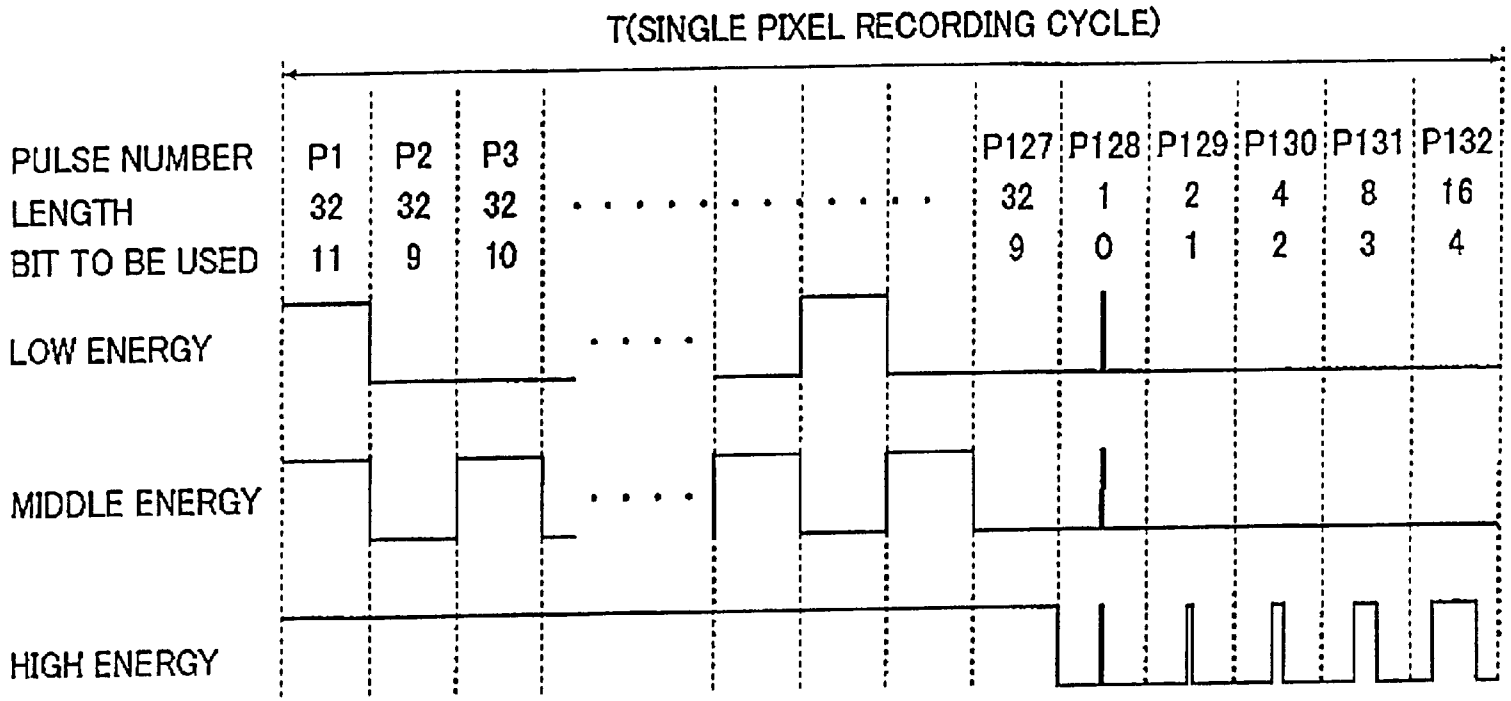

FIG.7(TABLE 3)

BIT TO BE USED :0~11 DATA LEVEL 1027

| DISPERSION | PIXEL POSITION(0~191) | | | | | | | | | | | | | | | | | | | |
|---|---|---|---|---|---|---|---|---|---|---|---|---|---|---|---|---|---|---|---|---|
| | 0 | 1 | 2 | 3 | 4 | 5 | 6 | 7 | 8 | 9 | 10 | | 184 | 185 | 186 | 187 | 188 | 189 | 190 | 191 |
| 0 | 11 | 8 | 11 | 10 | 11 | 9 | 11 | 10 | 11 | 5 | 11 | | 10 | 11 | 9 | 11 | 10 | 11 | 8 | 11 |
| 1 | 10 | 11 | 7 | 11 | 10 | 11 | 9 | 11 | 10 | 11 | 8 | | 11 | 10 | 11 | 9 | 11 | 10 | 11 | 5 |
| 2 | 11 | 10 | 11 | 8 | 11 | 10 | 11 | 9 | 11 | 10 | 11 | | 7 | 11 | 10 | 11 | 9 | 11 | 10 | 11 |
| 3 | 9 | 11 | 10 | 11 | 6 | 11 | 10 | 11 | 9 | 11 | 10 | | 11 | 8 | 11 | 10 | 11 | 9 | 11 | 10 |
| 4 | 11 | 9 | 11 | 10 | 11 | 8 | 11 | 10 | 11 | 9 | 11 | | 10 | 11 | 6 | 11 | 10 | 11 | 9 | 11 |
| 5 | 10 | 11 | 8 | 11 | 10 | 11 | 7 | 11 | 10 | 11 | 9 | | 11 | 10 | 11 | 8 | 11 | 10 | 11 | 9 |
| 6 | 11 | 10 | 11 | 9 | 11 | 10 | 11 | 8 | 11 | 10 | 11 | . . . | 9 | 11 | 10 | 11 | 7 | 11 | 10 | 11 |
| 7 | 8 | 11 | 10 | 11 | 9 | 11 | 10 | 11 | 5 | 11 | 10 | | 11 | 9 | 11 | 10 | 11 | 8 | 11 | 10 |
| 8 | 11 | 7 | 11 | 10 | 11 | 9 | 11 | 10 | 11 | 8 | 11 | | 10 | 11 | 9 | 11 | 10 | 11 | 5 | 11 |
| 9 | 10 | 11 | 8 | 11 | 10 | 11 | 9 | 11 | 10 | 11 | 7 | | 11 | 10 | 11 | 9 | 11 | 10 | 11 | 8 |
| 10 | 11 | 10 | 11 | 6 | 11 | 10 | 11 | 9 | 11 | 10 | 11 | | 8 | 11 | 10 | 11 | 9 | 11 | 10 | 11 |
| 11 | 8 | 11 | 10 | 11 | 8 | 11 | 10 | 11 | 9 | 11 | 10 | | 11 | 6 | 11 | 10 | 11 | 9 | 11 | 10 |
| ⋮ | | | | | . . . | | | | | | | | | | | . . . | | | | |
| 125 | 10 | 10 | 11 | 9 | 11 | 10 | 11 | 7 | 11 | 10 | 11 | | 9 | 11 | 10 | 11 | 8 | 11 | 10 | 11 |
| 126 | 11 | 11 | 10 | 11 | 9 | 11 | 10 | 11 | 8 | 11 | 10 | | 11 | 9 | 11 | 10 | 11 | 7 | 11 | 10 |
| 127 | 0 | 0 | 0 | 0 | 0 | 0 | 0 | 0 | 0 | 0 | 0 | | 0 | 0 | 0 | 0 | 0 | 0 | 0 | 0 |
| 128 | 1 | 1 | 1 | 1 | 1 | 1 | 1 | 1 | 1 | 1 | 1 | | 1 | 1 | 1 | 1 | 1 | 1 | 1 | 1 |
| 129 | 2 | 2 | 2 | 2 | 2 | 2 | 2 | 2 | 2 | 2 | 2 | | 2 | 2 | 2 | 2 | 2 | 2 | 2 | 2 |
| 130 | 3 | 3 | 3 | 3 | 3 | 3 | 3 | 3 | 3 | 3 | 3 | | 3 | 3 | 3 | 3 | 3 | 3 | 3 | 3 |
| 131 | 4 | 4 | 4 | 4 | 4 | 4 | 4 | 4 | 4 | 4 | 4 | | 4 | 4 | 4 | 4 | 4 | 4 | 4 | 4 |

IMAGE RECORDING METHOD AND APPARATUS

BACKGROUND OF THE INVENTION

1. Field of the Invention

The present invention relates to an image recording method and an image recording apparatus, and more especially to an image recording method and an image recoding apparatus for, e.g., an apparatus for performing main-scanning of a recording medium to be sub-scanned and transferred, and then recording an image, in which the image is dispersion-recorded in a direction of sub-scanning.

2. Description of the Related Art

Conventionally, an image recording apparatus using a thermal head to record an image on a recording medium, has widely been used. Image recording apparatus like this, a thermal recording material, which is the recording medium, is pressed onto a line-type thermal head on which a plurality of heating elements are arranged in one-dimensional direction. While the heating elements are being controlled respectively in response to image data, the thermal recording material is transferred in a direction perpendicular to the one-dimensional direction, resulting in recording a desired two-dimensional gradation image.

In this case, the gradation image is formed as shown in FIG. 4A. Namely, the image of gradation D=1 is formed by activating the heating elements for t [seconds]. Further, the image of gradation D=2 is formed by activating the heating elements for 2t [seconds]. Similarly, the images of gradation D=3 to D=5 are formed by heating the heating elements for 3t to 5t [seconds], respectively.

Thus, pixels having different light-emission areas in accordance with gradation are formed on the thermal recording medium within a single pixel width in the transfer direction, as shown in FIG. 4B. Thereby, a gradation image is recorded. In the above example, a case of modulation of the pulse width has been described. However, even in a case of modulation of a number of pulses, a gradation image is recorded in substantially the same manner as in a case of modulation of the pulse width as above.

Incidentally, when a gradation image is recorded like this, each pixel is always recorded from a constant point (point "a" in FIG. 4A). Since the point "b" side in a single pixel width in the transfer direction becomes non-recorded portion, the recorded image becomes concentrated on the point "a" side as above. Therefore, when a formed two-dimensional image is viewed over its entirety, there occurs a drawback that the image becomes conspicuously coarse.

In order to overcome this drawback, it is effective to dispersion-record the image data. Various types of technologies therefor have been proposed. For example, the technology of "Image Recording Method and Apparatus" disclosed in JP 07-96625 A corresponded to an application made by the assignee for the present invention also can be given as one example of such a technology.

According to this technology, when the image is one-dimensionally recorded on the recording medium using an image recording unit, and either the recording medium or the image recording unit is moved in a direction perpendicular to the one-dimensional direction to record the image, and simultaneously, the multi-gradation image data of each of pixels constituting the image are divided into a plurality of substantially equal portions of image data. Based on this plurality of divided image data, the image is dispersed in a direction in which the recording medium or the image recording unit, is moved and thus recorded.

According to this technology, the image data of each of the pixels constituting the image is divided into a plurality of substantially equal portions of image data. Based on the divided image data, the image is dispersed in a direction in which the recording medium or the image recording unit is moved thereby recording the image. This produces the result that the roughness occurred in recording the two-dimensional gradation image disappears, and it becomes possible to perform a record with high image quality.

Further, in a technology of "Image Recording Method" disclosed in JP 10-44509 A corresponded to an application which was also filed by the assignee for the present application, an image is recorded using an image recording unit in a one-dimensional manner onto a recording medium, and also, either the recording medium or the image recording unit is moved in a direction perpendicular to the one-dimensional direction to record the image, and the multi-gradation image data of the image elements constituting the image are divided into a plurality of number of substantially equal portions of image data. This image data is allotted to a part of the recording points that are divided into a number of the image data or more. Then, the image is dispersed in the moving direction in which the recording unit or the image recording unit is moved and thus recorded.

According to this technology, it becomes possible to prevent deterioration such fuzziness of the image quality in the low density areas, in which there has been a possibility of such deterioration occurring in the technology discussed above, and this makes it possible to apply the image dispersion-recording method more effectively.

However, even when this method is used, there occurs a recording sound caused by a solid image formed using the same thermal pulse (heating pulse). This is owing that between the heating body and the recording layer of heat sensitive recording material, burning-in caused by heating and fading at the time of transferring are repeated.

SUMMARY OF THE INVENTION

The present invention was developed in view of the above-mentioned problem. This invention has an object to provide an image recording method and apparatus capable of easily preventing a recording sound in the above-mentioned dispersion-recording technology from generating.

To obtain the object, an image recording method relating to the present invention is characterized by recording a pixel forming the image using a plurality of pulses having the step of shifting a thermal pattern between neighboring pixels to perform said image recording.

Further, it is preferable that the image recording method has the step of making a number of heating elements being activated, substantially uniform at each recording time.

The invention can be embodied as an image recording apparatus as below.

Namely, the image recording apparatus relating to the present invention is characterized by having an image recording unit which records an image in a direction, a transfer unit which transfers the image recording unit with relative to a recording medium, which are moved in mutually perpendicular directions to the direction, and a recording control unit which performs control so as to record a single pixel using a plurality of pulses upon recording of said image, the recording control unit performing control so that thermal patterns at neighboring pixels are shifted to perform the image recording.

It is preferable that the recording control unit makes a number of heating elements being activated, substantially uniform at each recording time.

BRIEF DESCRIPTION OF THE DRAWINGS

In the accompanying drawings:

FIG. 1A is a timing chart according to a conventional art, and FIG. 1B is a timing chart according to the embodiment of the present embodiment;

FIG. 3 is an explanatory diagram of heating patterns according to the embodiment of the image recording method of the present invention; FIG. 4A is an explanatory diagram of a drive signal, and FIG. 4B is an explanatory diagram of an image formed thereby.

FIG. 5 shows examples of combination of some pulse widths (Table 1).

FIG. 6 shows an example of correspondences for forming a basis of a table stored (Table 2).

FIG. 7 shows a table used for designating the bits to be used in the case where a solid image of 1,027 steps of gradation is to be recorded (Table 3).

DETAILED DESCRIPTION OF THE PREFERRED EMBODIMENTS

At first, explanation will be made of a summary of an image recording method on the basis of the present invention.

Figure 1A:
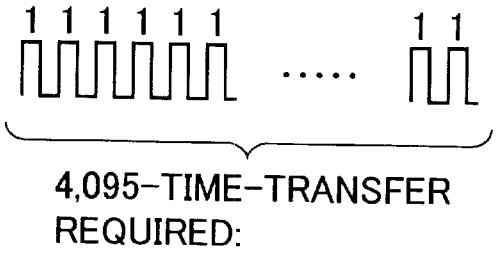
FIG. 1A PRIOR ART
FIGS. 1A and 1B are explanatory diagrams of a construction of an embodiment of an image recording apparatus to which an image recording method is applied, according to the present invention.
Figure 1B:
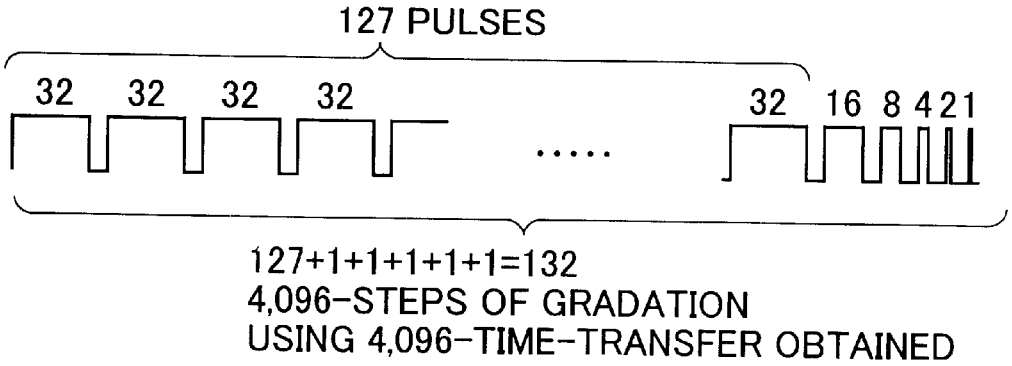

FIGS. 1A and 1B show, as one example, a composition of a dispersion-recording pulse using an image recording method according to a conventional art, and used with the image recording method which forms the basis of the present invention, in the case where a 12-bit-image data having 4096 steps of gradation is to be recorded, this figure in comparison with the case of 4,095 steps of gradation.

As shown in FIGS. 1A and 1B, according to the conventional art, 4,095 pulses each having a width of 1 are used to transfer a pulse by 4,095 times. In contrast, according to the image recording method which forms the basis of the present invention as shown in FIG. 1B, a pulse having a width of 32 (which indicates a pulse having a width equivalent to 32 pulses each having a width of 1, and so on hereinafter) is used as the basis, and for fractional widths which cannot be recorded, pulses of widths of 16, 8, 4, 2 and 1 are appropriately combined and then recorded. In this example, the number of times of the pulse transfer is reduced to 132 times, so that the number of times are drastically reduced.

Here, the above-mentioned basic pulse width which is used in the image recording method that forms the basis of the present invention, is not limited to the width of 32, but rather, a pulse having a width of 16 or 8 may also be preferably used. If a basic pulse width which is to be used becomes shorter (i.e., smaller), then the number of times of the pulse transfer naturally increases. However, on the whole, it is possible for this number of times to decrease to an extent which cannot even be compared to the conventional art (refer to FIG. 1 showing examples of combinations of pulse widths). Further, in the case where the basic pulse width to be used, is made to be shorter (smaller), an effect appears such that aspects such as coarseness of an image are improved.

In FIG. 5 (Table 1), combination of 4,095 numbers of recording pulses in a case where, e.g., 4,096 steps of gradation are expressed.

Detailed explanation will be made of the embodiment of the present invention, based on a preferred example shown in the accompanying drawings. Note that the above-mentioned technology of "Image Recording Method and Apparatus" disclosed in JP 07-96625 A is used as a base for the following explanation.

Figure 2:
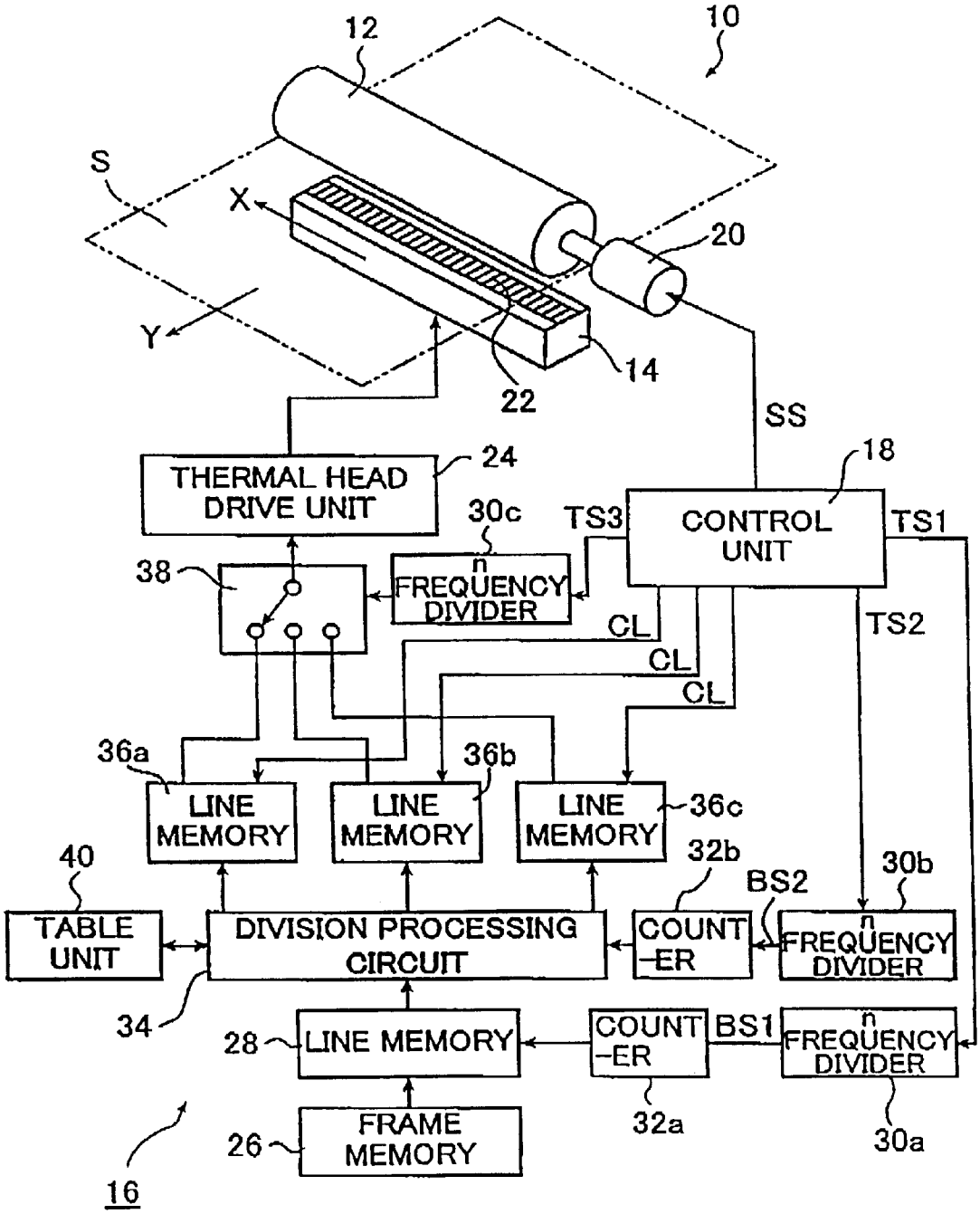
FIG. 2 is an explanatory diagram of the construction of the embodiment of the image recording apparatus to which the image recording method is applied, according to the embodiment of the present invention.
Figures 4A, 4B:
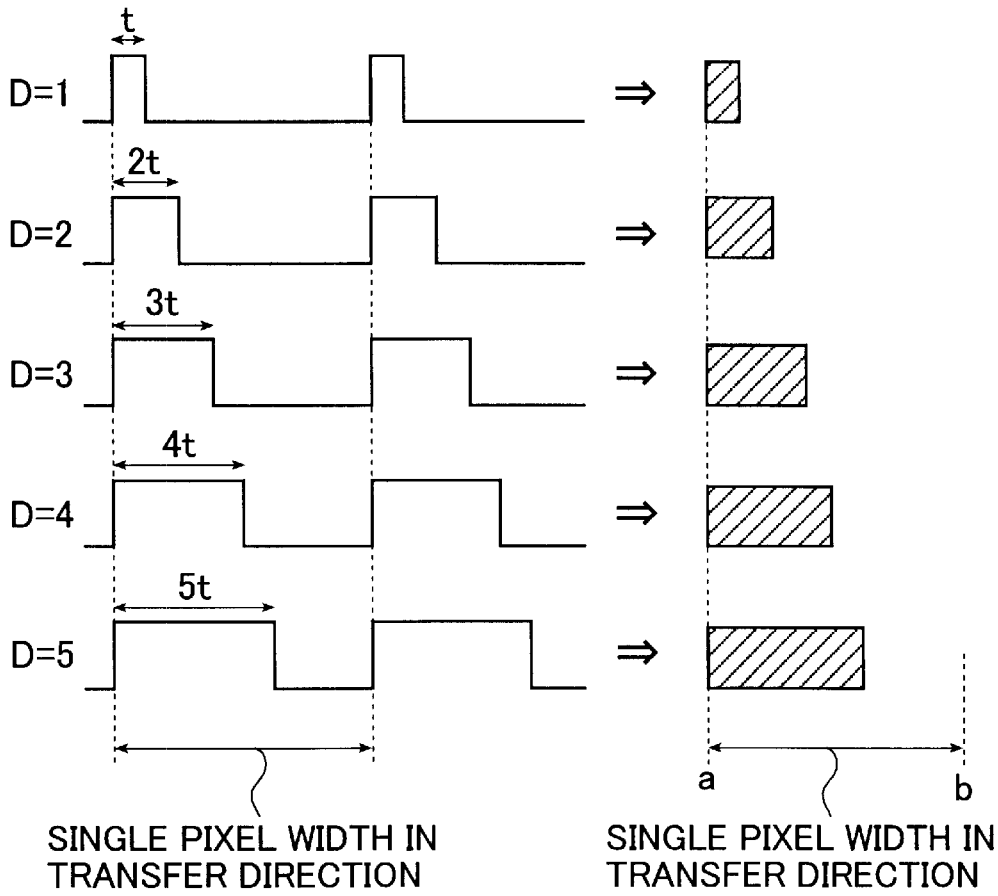
FIG.4A PRIOR ART
FIG.4B PRIOR ART
FIGS. 4A and 4B are explanatory diagrams of operation when a conventional pulse width modulation is performed.

FIG. 2 shows an image recording apparatus 10 using a thermal head to which the image recording method of the present invention is applied. In the image recording apparatus 10, a sheet-shaped thermal recording material S is sandwiched between a platen roller 12 and the thermal head 14 as an image recording unit. In this state, the material S is transferred in the direction indicated by an arrow Y using the platen roller 12 controlled by an image recording control device 16 for controlling dispersion-recording in the image recording method of the present invention. Further, the thermal head 14 controlled by the image recording control device 16, records a gradation image onto the material S in a one-dimensional direction (i.e., the direction of an arrow X), so that a two-dimensional gradation image is recorded.

The platen roller 12 is rotated using a step motor 20 as a recording medium moving unit in accordance with control performed by a control unit 18 for the image recording control device 16, and thus the platen roller 12 transfers the thermal recording material S in the direction of the arrow Y. The thermal head 14 is constituted by many heating elements 22 arranged in a one-dimensional direction (i.e., the direction of the arrow X). Each of the heating elements 22 heats up using a driving electric current provided from a thermal head drive unit 24 for the image recording control device 16, so as to make the thermal(heat sensitive) recording material S emit color(s) in predetermined gradation.

Here, the image recording control device 16 is equipped with a frame memory 26 for recording image data corresponding to a single page; a line memory 28 for recording, two-dimensional image data that is recorded in the frame memory 26 by each one-dimensional image data; a divided image data memory, i.e. line memories 36*a*, 36*b* and 36*c*, each for recording divided image data that in which total image data that can be obtained by the one-dimensional image data is divided using a below-mentioned method; the thermal head drive unit 24 for driving the thermal head 14 based on the divided image data and recording an image onto the thermal recording material S; and the control unit 18 for controlling them.

Conventionally, when the so-called division-and-recording is performed, calculation regarding whether a certain pulse is turned on or turned off, is frequently performed with a method of comparing image data with count values. Accordingly, when high-gradation expression is used, tendency that an amount of calculation grows greater and greater is as described above. Then, in the image recording method forming the base of the present invention, a one-to-one correspondence is created between a specific bit among the image data and the pulse to be used which have a predetermined width, the correspondence is defined as a table in advance, and the image data can easily be converted into a pulse sequence.

The embodiment will be explained, returning now to FIG. 2.

The control unit 18 for the image recording control device 16 supplies a predetermined drive signal SS to the step motor 20, and outputs timing signals TS1–TS3 and a read-out clock signals CL, which correspond to the drive signal SS. In this case, the control unit 18 functions as a recording position detection unit for detecting a position where the image is recorded using the thermal head 14, based on the above-mentioned timing signals TS1–TS3.

The timing signal TS1 is further supplied to n-frequency divider 30*a*. The n-frequency divider 30*a* provides this timing signal TS1 to the line memory 28 by way of a counter 32*a*, as a divided frequency signal BS1 having a frequency of 1/n. Note that the line memory 28 reads from the frame memory 26. The one-dimensional image data are recorded on the thermal recording material S in the direction of the arrow X in accordance with the divided frequency signal BS1.

Further, the timing signal TS2 is supplied to an n frequency divider 30*b* while following the timing signal TS1 with a delay of one pulse width, and the n frequency divider 30*b* provides the timing signal TS2 to a division processing circuit 34 as a divided frequency signal BS2 having a frequency of 1/n. As described below, the division processing circuit 34 cyclically provides this as an n group of one-dimensional image data to line memories (the divided image data recording means) 36*a* to 36*c* in a cyclical manner, based on each image data read out from the line memory 28 in accordance with the divided frequency signal BS2, with reference to the table stored in a table storing unit 40.

The timing signal TS3 is further supplied to a switching device 38 through an n frequency divider 30*c* while following the timing signal TS2 with a delay of one pulse width. This switching device (i.e., image data selection unit) 38 is arranged between the thermal head drive unit 24 and the line memories 36*a*–36*c*, selectively switches among the line memories 36*a*–36*c* according to the timing signal TS3, and connects to the thermal head drive unit 24. Note that the read-out clock signal CL is supplied from the control unit 18 to the line memories 36*a* to 36*c*.

The image recording apparatus 10 according to this embodiment is basically constituted as above. Hereinafter, explanation will be made of operations thereof, using the example depicted in FIG. 1 of 132 steps of dispersion, namely, n=132.

In FIG. 6, there is depicted an example of correspondences, which are to form the basis of the table stored in the table storing unit 40 mentioned above (i.e., a dispersion-number-pixel position correspondence table), established between the pulse number and pulse width, and the bits among the image data corresponded thereto (hereinafter, referred to as bits to be used), in the case of 132 steps of dispersion. Note that, here, an energy level is divided into three levels.

As shown in FIG. 6, among 132 numbers of pulses of P1, P2 . . . P132 in case of 132 steps of dispersion, the pulses P1, P2 . . . P127 are pulses each having a width of 32, and the pulses P128, P129, P130, P131 and P132 following thereafter are pulses having widths of 1, 2, 4, 8 and 16, respectively, and that these correspond to bits to be used of 5, 6, 7, 8, 9, 10, and 11, and bits to be used of 0, 1, 2, 3 and 4, respectively.

FIG. 7 (Table 3) shows a table used to designate the bits to be used in the case where a solid image of 1,027 steps of gradation is to be recorded for each dispersion-recording sequence (i.e. this is the vertical dispersion in FIG. 7), and for each thermal element 22 (inside one block) number (i.e., in the chart, this is the pixel position in the horizontal direction) on the thermal head 14 in case of data (gradation) 1027. Here, an example is illustrated in which the pulse pattern to be used, is made to be as random as possible between the pixel positions in the horizontal direction in order to prevent irregularity in the cycles at the time when the contact printed image is recorded.

FIG. 3 shows the width of the pulse (i.e., duration of time of the electrical drive) at the time when the heating elements 22 on the thermal head 14 are actually driven according to the pulse pattern to be used, which is depicted in FIG. 7. What FIG. 3 shows is that, when 1,027 steps of gradation is to be recorded, at the first dispersion, a pulse having a width of 32 is to be used at the pixel positions 0, 4, 8 . . . 185 and 189, and also, at the 127 steps of dispersion, a pulse having a width of 1 is to be used at all of the pixel positions 0 to 191.

The above-mentioned division processing circuit 34 has the table storing unit 40 which stores a table group corresponding to the above-mentioned FIG. 7 by each of steps of gradation (degree of darkness of the record) and corresponding to at least single dispersion pattern. The circuit 34 examines the bits in the image data of each line which has been read from the line memory 28, and then in the case where the bit or bits which are to be used are present in this data, the circuit 34 cross-references these bits against a table having the format shown in FIG. 3 as mentioned above. Thus, the bits are converted into a signal that outputs pulses of the predetermined widths.

In this embodiment, the results of the verification in the division processing circuit 34 as above-mentioned are cyclically output to the three line-memories 36*a*, 36*b* and 36*c*. However, it is not necessary to adopt only this method. Further, each of the tables is shown just as single examples. The methods different from these may be adopted.

Hereinafter, explanation will be made of operations of the image recording apparatus according to this embodiment constituted as above-mentioned.

First, the control unit 18 outputs the drive signal SS to the step motor 20, the step motor 20 rotates the platen roller 12 based on this drive signal SS, and the thermal recording material S is transferred in the direction of the arrow Y at a predetermined speed. On the other hand, the control unit 18 generates timing signals TS1–TS3 which are synchronized to or proportionate to the drive signal Ss, and these signals TS1–TS3 are outputted to the n frequency dividers 30*a* and 30*b* and to the switching device 38.

The n frequency divider 30*a* divides the frequency of the timing signal TS1 into n-sections and outputs this as the divided frequency signal BS1 to the line memory 28. The line memory 28 reads the one-dimensional image data from the frame memory 26 based on this divided frequency signal BS1, and stores the data temporarily. Next, the n frequency divider 30*b* divides the frequency of the timing signal TS2, which follows the timing signal TS1 with a delay of one pulse width, into n-sections, and outputs this as the divided frequency signal BS2 to the division processing circuit 34. The division processing circuit 34 reads the one-dimensional image data recorded in the line memory 28, based on the divided frequency signal BS2, and generates n combination of the one-dimensional image data by means of the above-described process of referencing a table from this one-dimensional image data.

The divided image data generated as above-mentioned is cyclically stored in each of the line memories 36*a*–36*c* as the one-dimensional image data. Then, the control unit 18 switches controls on the switching device 38 according to the timing signal TS3 which follows the timing signal TS2 with delay of a single pulse width, and sequentially supplies the divided image data recorded in the line memories 36*a*–36*c* to the thermal head drive unit 24.

The thermal head drive unit 24 first provides to the plurality of heating elements 22, which constitute the thermal head 14, a drive electric current, which is based on the divided image data from the line memory 36*a*, and forms a single pixel by performing recording on the thermal recording material S in a one-dimension direction of the direction of the arrow X. Next, the thermal head drive unit 24 sub-sequentially supplies, to the heating elements 22 a drive electric current based on the divided image data from the line memory 36*b* and the divided image data from the line memory 36*c*, and forms the subsequent 2 pixels.

In this embodiment, then, the thermal patterns generated at neighboring pixels are shifted over and then recording is performed, and additionally, the number of heating elements being on during each of the recording times is made substantially uniform. Specifically, particularly in the case of an image such as a contact printed image in which recording noise is likely to be generated, the positions of the heating elements made to be heated up are dispersed in correspondence to their corresponding pixel positions (i.e., the width direction at the time of performing recording), and also, are made to be equivalent to each other with respect to time (i.e., the width direction at the time of recording), as shown in FIG. 3.

Namely, in FIG. 3, when dispersion-recording is to be performed from dispersion 0 to dispersion 131, control is performed so that (1) it is avoided that neighboring heating elements are not on at each time, and (2) the number of activated heating elements 22 is kept substantially uniform (see the figures in the rightmost column in the table).

Further, in FIG. 3, the number of pulses having a width of 32 in the horizontal direction is counted (i.e., the chart shows the number of pulses which are on at each recording time), and it is evident that the number of pulses lying in ON-status at each recording time is 47–49, being substantially the same number. This indicates that fluctuations in voltage during each of the times are few, and therefore, voltage drops are also small.

Additionally, as shown in FIG. 3, the number of activated pulses is 47–49, being substantially the same number, so that the number of heating elements which are heated up at each of the times, are mutually substantially same. Accordingly, the amount of the thermal film surface layer which is fused caused by heat keeps constant, resistance (a type of frictional resistance) when the film is transferred does not change, and generation of sound (namely recording noise) when transfer is suppressed.

In the above embodiment, it is noted that an example is shown in which the thermal patterns are made to be mutually different between the neighboring pixels. However, likewise, also when the thermal patterns are made to be different across neighboring lines of image data (ex, an odd line and an even line), the above-mentioned actions and effects can be obtained.

The above embodiments are directed to one example of the present invention. The present invention is not limited to the embodiments. Needless to say, various types of modification and improvement may be made within a scope which does not alter the gist of the present invention.

As above-mentioned, according to the present invention, in the dispersion-recording technology using a thermal head, a effect is produced such that the image recording method capable of easily preventing noise generation when recording is realized, and additionally, this can be embodied as the image recording apparatus.

More specifically, by dispersion-recording the image as shown in FIG. 3, the timing when the neighboring pixels are heated up, is shifted, and the number of pulses which are activated at each timing is kept substantially the same, so that a voltage drop may be suppressed and fluctuations in sticking between the recording layer and the thermal head are decreased, producing the result that the transfer of the film can be smoothed and the sound generated at the transfer, i.e. the recording noise can be restrained.

Additionally, in the above embodiment, an example is illustrated that a heating pattern is differently changed between neighboring pixels. Likewise, a heating pattern may differently be changed between neighboring lines of the image data (e.g. between an odd line and an even line of the image data), resulting in obtaining operation and effect.

As above-mentioned, according to the present invention, an image recording method capable of easily preventing a recording sound from being generated in a dispersion-recording technology using a heating element such as a thermal head. Further according thereto, the image recording method can be embodied.

Each of the above-mentioned embodiments illustrates an example of the present invention. Therefore, the present invention is not limited within these embodiments. Namely, various kinds of modification and improvement may be performed therewithin.

As above-explained, according to the present invention, an image recording method and an image recording apparatus can be provided in a dispersion-recording technology using a thermal head.

More concretely, heating timing is shifted between neighboring pixels and a number of pulse lying in ON-status at each time are substantially same, thereby refraining a voltage drop. Further, adhesion often caused by burning-in between a recording layer and a thermal head is more decreased, thereby smoothly transferring a film and decreasing a recording sound.

What is claimed is:

1. An image recording method for recording a pixel forming the image using a plurality of pulses comprising:

storing a table for selectively activating heating elements for recording the image; and shifting a thermal pattern between neighboring pixels to perform said image recording based on contents of the table.

2. The image recording method according to claim 1 further comprising the step of:

making a number of heating elements being activated, substantially uniform at each recording time.

3. The method of claim 1, wherein the table contains data to activate non-adjacent heating elements in a staggered heating pattern at a predetermined point in time, said staggered heating pattern varying according to a data level for the image.

4. The method of claim 3, wherein said staggered heating pattern varies according to a dispersion level of data to be recorded.

5. The method of claim 4, wherein said staggered heating pattern varies according to a bit number of input image data.

6. The method of claim 5, further comprising: dividing the input image data; extracting the bit number from the input image; and correlating the bit number with an entry of the table to obtain the staggered heating pattern.

7. The image recording apparatus comprising:

an image recording unit which records an image in a direction, a transfer unit which transfers said image recording unit with relative to a recording medium, which are moved in mutually perpendicular directions to said direction, a data storing unit storing data for selectively activating image generating units for recording the image in said direction, and a recording control unit which performs control so as to record a single pixel using a plurality of pulses upon recording of said image, said recording control unit performing control so that thermal patterns at neighboring pixels are shifted to perform said image recording based on the contents of the data storing unit.

8. The image recording apparatus according to claim 7, said recording control unit making a number of heating elements being activated, substantially uniform at each recording time.

9. The image recording apparatus according to claim 7, said image recording unit being provided with a thermal head.

10. The apparatus of claim 7, wherein the table contains data to activate non-adjacent heating elements in a staggered heating pattern at a predetermined point in time, said staggered heating pattern varying according to a data level for the image.

11. The apparatus of claim 10, wherein said staggered heating pattern varies according to a dispersion level of data to be recorded.

12. The apparatus of claim 11, wherein said staggered heating pattern varies according to a bit number of the image data.

13. The apparatus of claim 12, further comprising: a dividing circuit for receiving input image data, said dividing circuit further extracting the bit number from the image data and correlating the bit number with a table entry to obtain the staggered heating pattern.

* * * * *